US011079098B1

(12) United States Patent
Schickel et al.

(10) Patent No.: US 11,079,098 B1
(45) Date of Patent: Aug. 3, 2021

(54) LIGHT ASSEMBLY WITH WATER VAPOR REMOVAL SYSTEM

(71) Applicant: VARROC LIGHTING SYSTEMS, s.r.o., Šenov u Nového Jičína (CZ)

(72) Inventors: Dylan Schickel, Belleville, MI (US); Paul Lyon, Ann Arbor, MI (US)

(73) Assignee: VARROC LIGHTING SYSTEMS, S.R.O., Senov U Nového Jicína (CZ)

( * ) Notice: Subject to any disclaimer, the term of this patent is extended or adjusted under 35 U.S.C. 154(b) by 0 days.

(21) Appl. No.: 16/827,949

(22) Filed: Mar. 24, 2020

(51) Int. Cl.
*F21V 29/54* (2015.01)
*F21V 29/83* (2015.01)

(52) U.S. Cl.
CPC ..... *F21V 29/54* (2015.01); *F21V 29/83* (2015.01)

(58) Field of Classification Search
CPC . F21V 29/54; F21V 29/83; F21S 45/30; F21S 45/60
See application file for complete search history.

(56) References Cited

U.S. PATENT DOCUMENTS 7,249,868 B2 * 7/2007 Chinniah ..... F21S 45/47 362/294
9,726,362 B2 * 8/2017 Rosen ..... F21K 9/20
2004/0120156 A1 * 6/2004 Ryan ..... F21V 29/773 362/373
2006/0181894 A1 * 8/2006 Chinniah ..... F21V 29/83 362/547
2007/0121336 A1 * 5/2007 Chinniah ..... F21V 15/01 362/507
2008/0043480 A1 * 2/2008 Kong ..... F21K 9/00 362/373
2011/0025211 A1 * 2/2011 Bae ..... F21V 29/763 315/113
2013/0114279 A1 * 5/2013 Marley ..... F21S 41/143 362/516
2018/0080620 A1 * 3/2018 Kim ..... F21S 45/435

FOREIGN PATENT DOCUMENTS

WO 2018178532 A1 10/2018

* cited by examiner

*Primary Examiner* — William N Harris
(74) *Attorney, Agent, or Firm* — Cantor Colburn LLP

(57) ABSTRACT

A light assembly includes a substantially closed housing, a light source, a thermoelectric device, and a moisture expulsion device. The housing is defines a chamber, and includes a lens. The light source is adapted to direct light from the chamber and through the lens. The thermoelectric device includes a cold side and a hot side. The cold side is adapted to form condensation from moisture in the chamber. The moisture expulsion device includes a first segment in contact with the hot side and adapted to receive thermal heat from the hot side, and a second segment in contact with the first segment and exposed to an external environment for dissipation of moisture. The second segment is adapted to receive thermal heat from the first segment, and condensate from the cold side.

15 Claims, 2 Drawing Sheets

LIGHT ASSEMBLY WITH WATER VAPOR REMOVAL SYSTEM

The subject disclosure relates to a light assembly, and more particularly, to a light assembly having a water vapor removal system.

Light assemblies typically include a substantially closed housing that defines a chamber. A light source in the chamber is adapted to direct light through a lens of the housing. Unfortunately, moisture may permeate through the housing, or otherwise gain access therein, and then condense and form water droplets on the inner surfaces of the light assembly. This condensation is visually displeasing, and the condensation, or the moisture itself, may degrade operation of light sources, instrumentation, and other components in the chamber.

Accordingly, it is desirable to provide an efficient means to remove moisture contained inside a light assembly.

SUMMARY

A light assembly according to one, non-limiting, embodiment of the present disclosure includes a substantially closed housing, a light source, and a thermoelectric device. The substantially closed housing defines a chamber, and includes a lens. The light source is adapted to direct light from the chamber and through the lens. The thermoelectric device includes a cold side and a hot side. The cold side is adapted to form condensation from moisture in the chamber.

Additionally to the foregoing embodiment, the light assembly includes a moisture expulsion device. The moisture expulsion device includes first and second segments. The first segment is in contact with the hot side, and is adapted to receive thermal heat from the hot side. The second segment is in contact with the first segment, and is exposed to an external environment for dissipation of moisture. The second segment is adapted to receive thermal heat from the first segment and condensate from the cold side.

In the alternative or additionally thereto, in the foregoing embodiment, the segment includes a porous material adapted to entrain the condensate.

In the alternative or additionally thereto, in the foregoing embodiment, the thermoelectric device is disposed substantially above the moisture expulsion device.

In the alternative or additionally thereto, in the foregoing embodiment, the light assembly includes a trough disposed beneath the cold side for receipt of the condensate, wherein the trough includes at least one hole orientated to direct condensate flow from the trough and into the second segment.

In the alternative or additionally thereto, in the foregoing embodiment, the trough includes a bottom and opposite first and second sides projecting upward from the bottom, and the at least one hole communicates through the bottom.

In the alternative or additionally thereto, in the foregoing embodiment, the cold side is carried by a plurality of fins.

In the alternative or additionally thereto, in the foregoing embodiment, the light assembly includes a frame engaged to the housing and extending about an opening in the housing, and engaged to and extending about the moisture expulsion device.

In the alternative or additionally thereto, in the foregoing embodiment, an expulsion cavity is defined by the frame and the second segment.

In the alternative or additionally thereto, in the foregoing embodiment, the light assembly includes a vent disposed over the opening.

In the alternative or additionally thereto, in the foregoing embodiment, the vent is a vapor diffuser.

In the alternative or additionally thereto, in the foregoing embodiment, the housing is made of plastic.

In the alternative or additionally thereto, in the foregoing embodiment, the first segment is solid and the second segment is porous.

A light assembly according to another embodiment includes a housing, a light source, a condensate production device, and a moisture expulsion device. The housing defines a chamber, and includes a lens, and the housing includes an opening. The light source adapted to direct light from the chamber and through the lens. The condensate production device is disposed in the chamber. The moisture expulsion device is adapted to receive condensate from the condensate production device, and expels the condensate as vapor through the opening.

Additionally to the foregoing embodiment, the moisture expulsion device is substantially disposed below the condensate production device.

In the alternative or additionally thereto, in the foregoing embodiment, the moisture expulsion device includes a porous segment for entrainment of the condensate.

In the alternative or additionally thereto, in the foregoing embodiment, the light assembly includes a frame engaged to the housing, and extends about the opening in the housing. The frame is further engaged to, and extends about the moisture expulsion device.

In the alternative or additionally thereto, in the foregoing embodiment, an expulsion cavity is defined by the frame and the porous segment, and is in direct fluid communication with the opening.

In the alternative or additionally thereto, in the foregoing embodiment, the light assembly includes, a vent disposed over the opening.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
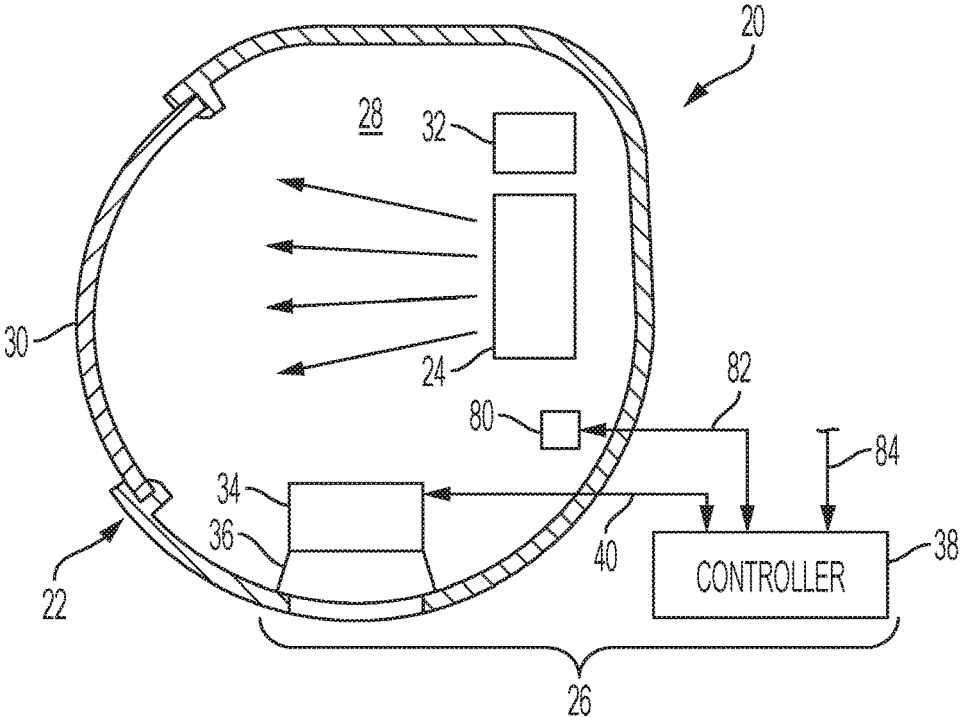
FIG. 1 is a schematic of a light assembly as one exemplary embodiment of the present disclosure.

The following description is merely exemplary in nature and is not intended to limit the present disclosure, its application or uses. It should be understood that throughout the drawings, corresponding reference numerals indicate like or corresponding parts and features. As used herein, the terms controller and/or module refer to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

In accordance with an exemplary embodiment, a light assembly 20 is illustrated in FIG. 1. In one embodiment, the light assembly 20 may be adapted for use in a vehicle (not shown). Non-limiting example of the light assembly 20 may include a head light assembly and a tail light assembly for use on motor vehicles.

The light assembly 20 includes a housing 22, a light source 24, and a water vapor removal system 26 that may be thermoelectric based. The housing 22 may be substantially closed, defines a chamber 28, and includes a lens 30 that may be generally transparent. The light source 24 radiates, or emits, light rays from within the chamber 28 for transmission through the lens 30. In one example, the light source 24 is in the chamber.

The housing 22, and/or lens 30, may be made of plastic such that the plastic may absorb moisture. Although the housing 22 is substantially closed, the moisture may be desorbed from the plastic, and thereby enter the chamber 28, via thermal energy from an external source (e.g., engine heat, sun load, and others), or an internal source (e.g., light source, electronics, and others). Unless removed, the moisture in the chamber 28 may result in water condensation, may have a displeasing appearance, and/or may degrade operation of the light assembly 20. In other embodiments, the housing may be made of other materials, and/or moisture may enter the chamber 28 via other means (e.g., diffusion, seal failure, etc.).

In another embodiment, the light assembly 20 may further include other instrumentation, and/or sensors 32 located in the chamber 28, and that may be negatively impacted by moisture. Non-limiting examples of such instrumentation 32 include cameras, radar devices, LCD screens, SLED, LIDAR, and others.

Figure 2:
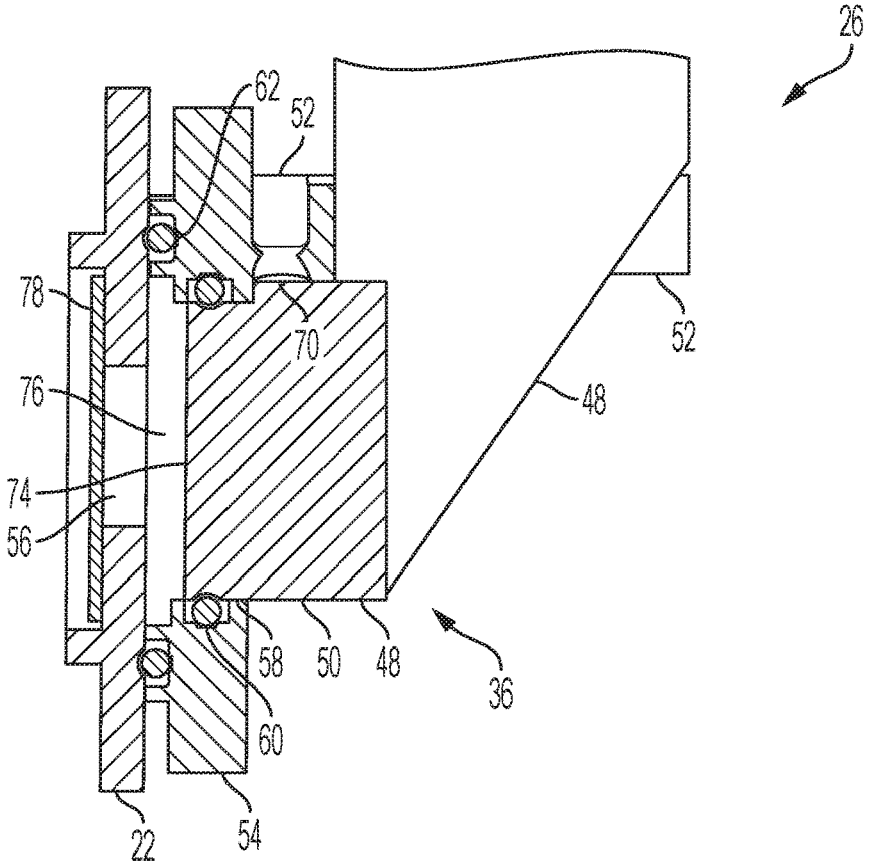
FIG. 2 is a partial cross section of a water vapor removal system of the light assembly.
Figure 3:
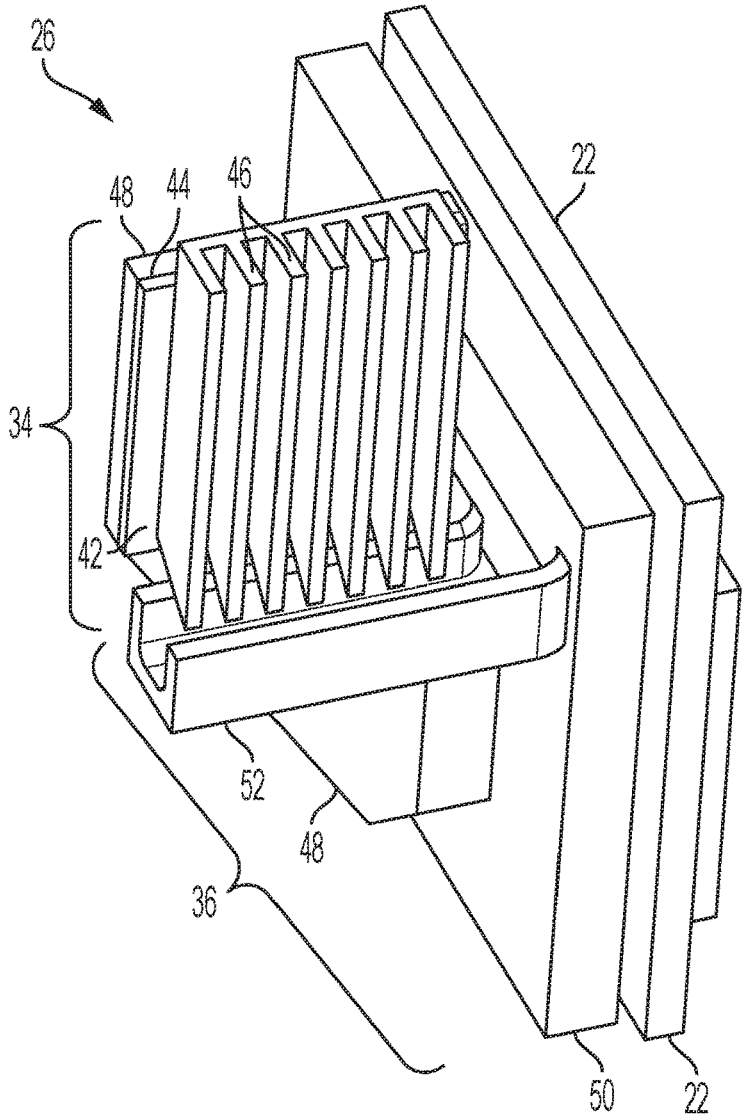
FIG. 3 is a perspective view of the water vapor removal system.

Referring to FIGS. 1 through 3, the water vapor removal system 26 is adapted to remove moisture from the chamber 28, and may include a condensate production device 34, a moisture expulsion device 36, and a controller 38. The condensate production device 34 is located in the chamber 28 and may include, or may be, a thermoelectric device. The condensate production device 34 may be electrically powered with the energization controlled by the controller 38 via a control signal (see arrow 40 in FIG. 1).

The condensate production device 34 includes a first side, or portion, 42, and a second side, or portion, 44. When energized, the first side is generally cold, and the second side is hot (i.e., appreciably warmer than the cold side 42). In operation, suspended moisture (i.e., water vapor) in the chamber 28 condenses upon the cold side 42. The condensed water is then received by the moisture expulsion device 36 that facilitates the collection and removal of the condensate from the light assembly 20. That is, in one embodiment, water is physically collected and removed. In another embodiment, moisture removal is achieved via vaporization. In yet another embodiment, water may be removed via direct wicking, or dripping to the exterior.

In one embodiment, the cold side 42 of the condensate production device 34 may be contoured, or textured, to facilitate condensation. For example, the cold side 42, may be or may be a plurality of fins 46 (see FIG. 3) with each fin extending substantially vertically for channeling the condensate in a downward direction via gravity. To facilitate this gravity feed of condensate, the moisture expulsion device 36 may be substantially located below the condensate production device 34.

In one non-limiting embodiment, the moisture expulsion device 36 of the water vapor removal system 26 is adapted to receive both the thermal energy from the hot side 44 of the condensate production device 34 via thermal conduction, and receive the condensate from the cold side 42. Once received, the water vapor removal system 26 forms water vapor from the condensate for expulsion from the light assembly 20. The moisture expulsion device 36 includes a first segment 48 and a second segment 50, and may further include a condensate flow structure 52 for the channeling of condensate. Examples of a condensate flow structure 52 include a trough (as illustrated in FIG. 3), and a wick.

The first segment 48 extends between, and is in contact with, the hot side 44 of the condensate production device 34 and the second segment 50 of the moisture expulsion device 36 for the conduction of heat from the hot side 44 to the second segment 50. In one embodiment, the first segment 48 is generally solid and is made of a material ideal for the thermal conduction of energy. For example, the first segment 48 may be metallic (e.g., aluminum). The second segment 50 may be made from a porous material, specific geometric structure, or surface treatment to facilitate vaporization of condensate conveyed via flow structure 52. With the thermal energy received from the first segment 48, the vaporization of the condensate by the second segment 50 is optimized.

Figure 4:
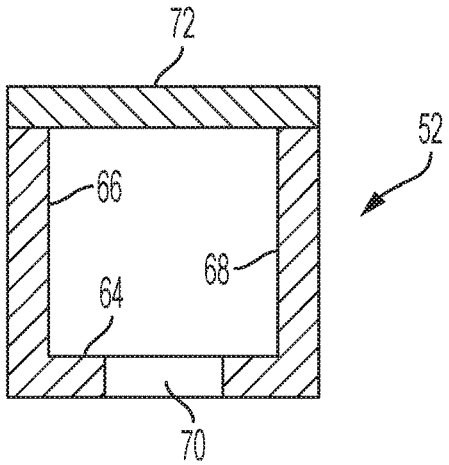
FIG. 4 is a cross section of a trough of the water vapor removal system.

Referring to FIGS. 2 through 4, the trough 52 includes a bottom 64 and opposite first and second sides 66, 68 each being attached to, and projecting upward from, the bottom 64. At least a receiving portion of the trough 52 is located directly below the cold side 42 of the condensate production device 34 for gravity fed receipt of the condensate. A downstream, or expulsion, portion of the trough 52 is adjacent to, and may be located directly above, the second segment 50 of the moisture expulsion device 36. The downstream portion of the trough 52 may include at least one hole 70 in the bottom 64 for gravity-fed condensate drainage into the second segment 50. In one embodiment, at least the downstream portion of the trough 52 may include a cover 72 to minimize evaporation of the condensate back into the chamber 28, see FIGS. 2 and 4. The second segment 50 may be porous for the entrainment of the condensate received from the hole(s) 70 in the trough 52. In alternate embodiments, the second segment 50 may include a specific geometric structure, or surface treatment to facilitate vaporization of condensate conveyed via flow structure 52. In one embodiment, the trough 52 may be an integral part of the first segment 48.

Referring again to FIG. 2, the water vapor removal system 26 may further include a frame 54 attached between the light assembly housing 22 and the moisture expulsion device 36. More specifically, the frame 54 extends about an opening 56 in the housing 22 that generally exposes the second segment 50 to an outside environment, and is attached to an outer periphery 58 of the moisture expulsion device 36, or second segment 50. In general, the second segment 50 is isolated from the chamber 28 by the solid first segment 48 and the frame 54. The attachment of the frame 54 to the moisture expulsion device 36 may include a seal 60 that may be circumferentially continuous. Similarly, the attachment of the frame 54 to the housing 22 may include a seal 62 that may be circumferentially continuous.

When the water vapor removal system 26 is fully assembled, the frame 54 and exterior or outward surface 74 of the second segment 50 include boundaries that define an expulsion cavity 76. The expulsion cavity 76 is in direct fluid communication with the opening 56 in the housing 22. The water vapor removal system 26 may further include a vent 78 that covers the opening 56 (see FIG. 2), and a humidity sensor 80 (see FIG. 1) adapted to send humidity signals (see arrow 82) to the controller 38. In one embodiment, the vent 78 may be a vapor diffuser. The water vapor emitted by the second segment 50 and into the expulsion cavity 76 is of a high concentration. This high concentration causes the vapor to diffuse through the vent 78 and to the outside environment.

Referring again to FIG. 1, the controller 38 is configured to receive at least one of the humidity signal 82 and an external signal (see arrow 84) used by the controller to energize the condensate production device 34. In the example where a humidity signal 82 is applied, the controller 38 may include a preprogrammed humidity threshold, which when exceeded, causes the condensate production device 34 to be energized. In another example, the external signal 84 may be an indication that the vehicle is running, this alone, may cause the controller 38 to effect energizing the production device 34. Other control arrangements using humidity signals and/or external signals may be realized to optimize the operation and power usage of the water vapor removal system 26.

In other embodiments, the moisture expulsion device 36 may include the first segment 48 and a condensate flow structure 52 as previously described. The condensate flow structure 52 directly penetrates through an opening in the light assembly housing 22, allowing for condensate to exit the light assembly primarily in liquid form. The downstream, or expulsion, portion of the condensate flow structure 52 may include a labyrinthine structure or material to prohibit the intrusion of water or dust into the light assembly. Various seals (not shown) may be utilized.

In yet other embodiments, the hot side 44, of the condensate production device 34 may include a heat sink for dissipating thermal energy. The heat sink may be oriented such that it is located outside of the light assembly housing 22 to optimize the dissipation of the thermal energy from the thermoelectric device.

Advantages and benefits of the present disclosure include an efficient means of maintaining low humidity conditions inside a light assembly thereby preventing condensation, and allowing humidity sensitive sub-systems and components inside the assembly to operate effectively. Further benefits include the lack of moving parts, optimal packaging, and low cost.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A light assembly comprising:
- a substantially closed housing defining a chamber, and including a lens;
- a light source adapted to direct light from the chamber and through the lens;
- a thermoelectric device including a cold side and a hot side, wherein the cold side is adapted to form condensation from moisture in the chamber; and
- a moisture expulsion device including a first segment in contact with the hot side and adapted to receive thermal heat from the hot side, and a second segment in contact with the first segment and exposed to an external environment for dissipation of moisture, wherein the second segment is adapted to receive thermal heat from the first segment and condensate from the cold side.

2. The light assembly set forth in claim 1, wherein the second segment includes a porous material adapted to entrain the condensate.

3. The light assembly set forth in claim 1, wherein the thermoelectric device is disposed substantially above the moisture expulsion device.

4. The light assembly set forth in claim 1, further comprising:
- a trough disposed beneath the cold side for receipt of the condensate, wherein the trough includes at least one hole orientated to direct condensate flow from the trough and into the second segment.

5. The light assembly set forth in claim 4, wherein the trough includes a bottom and opposite first and second sides projecting upward from the bottom, and the at least one hole communicates through the bottom.

6. The light assembly set forth in claim 1, wherein the cold side is carried by a plurality of fins.

7. The light assembly set forth in claim 1, further comprising:
- a frame engaged to the housing and extending about an opening in the housing, and engaged to and extending about the moisture expulsion device.

8. The light assembly set forth in claim 7, wherein an expulsion cavity is defined by the frame and the second segment.

9. The light assembly set forth in claim 8, further comprising:
- a vent disposed over the opening.

10. The light assembly set forth in claim 9, wherein the vent is a vapor diffuser.

11. The light assembly set forth in claim 1, wherein the housing is made of plastic.

12. The light assembly set forth in claim 1, wherein the first segment is solid and the second segment is porous.

13. A light assembly comprising:
- a housing defining a chamber, and including a lens, wherein the housing includes an opening;
- a light source adapted to direct light from the chamber and through the lens;
- a condensate production device disposed in the chamber;
- a moisture expulsion device adapted to receive condensate from the condensate production device and expel the condensate as vapor through the opening, wherein the moisture expulsion device is substantially disposed below the condensate production device, and wherein the moisture expulsion device includes a porous segment for entrainment of the condensate; and
- a frame engaged to the housing and extending about the opening in the housing, and engaged to and extending about the moisture expulsion device.

14. The light assembly set forth in claim 7, wherein an expulsion cavity is defined by the frame and the second segment, and is in direct fluid communication with the opening.

15. The light assembly set forth in claim 14, further comprising:
- a vent disposed over the opening.

* * * * *